US007216820B2

(12) United States Patent
Nelson et al.

(10) Patent No.: US 7,216,820 B2
(45) **Date of Patent: *May 15, 2007**

(54) FAUCET SPRAY HEAD ASSEMBLY

(75) Inventors: Alfred C. Nelson, Carmel, IN (US); Jeffrey L. Moore, Frankfort, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 339 days.

This patent is subject to a terminal disclaimer.

(21) Appl. No.: 10/973,789

(22) Filed: Oct. 26, 2004

(65) Prior Publication Data

US 2005/0077398 A1 Apr. 14, 2005

Related U.S. Application Data

(63) Continuation of application No. 10/350,237, filed on Jan. 23, 2003, now Pat. No. 6,938,837.

(51) Int. Cl.
*B05B 1/32* (2006.01)
*B05B 1/00* (2006.01)
*A62C 31/00* (2006.01)

(52) U.S. Cl. ..... 239/451; 239/460; 239/436; 239/437; 239/442; 239/600

(58) Field of Classification Search ..... 239/451, 239/460, 436, 437, 442, 443, 587.1, 600; 285/322, 330, 243, 913
See application file for complete search history.

(56) References Cited

U.S. PATENT DOCUMENTS

| | | | | |
|---|---|---|---|---|
| 3,062,416 | A * | 11/1962 | Cooprider | 222/153.13 |
| 4,117,858 | A | 10/1978 | Bucknell et al. | |
| 4,431,031 | A | 2/1984 | Ettlinger | |
| 4,433,799 | A * | 2/1984 | Corsette | 222/309 |
| 4,812,070 | A | 3/1989 | Marty | |
| 5,073,991 | A | 12/1991 | Marty | |
| 5,349,987 | A | 9/1994 | Shieh | |
| 5,546,978 | A | 8/1996 | Parker | |

(Continued)

OTHER PUBLICATIONS

PICTURE 1 of Amfag Idea Product, Mar. 2001.

(Continued)

*Primary Examiner*—Davis Hwu
(74) *Attorney, Agent, or Firm*—Woodard, Emhardt, Moriarty, McNett & Henry LLP

(57) ABSTRACT

A faucet spray head includes a diverter valve that has a diverter stem constructed and arranged to control water flow patterns. The stem includes a neck and a head that is larger than the neck. A shell encloses the diverter valve, and the shell has an opening through which the stem extends. A pivot member is coupled to the shell, and a rocker arm is pivotally coupled to the pivot member. The rocker arm has a retention opening, and the retention opening is adapted to slidably receive and retain the head of the stem during assembly of the rocker arm to the pivot member. The rocker arm is attached to the diverter valve in order to actuate the valve. The spray head includes lock pins that are configured to engage a lock insert that is secured to a spout.

25 Claims, 6 Drawing Sheets

U.S. PATENT DOCUMENTS

| | | | |
|---|---|---|---|
| 5,560,548 | A | 10/1996 | Mueller et al. |
| 5,592,536 | A | 1/1997 | Tokarz |
| 5,624,073 | A | 4/1997 | Mueller et al. |
| 5,685,829 | A | 11/1997 | Allen |
| 5,707,011 | A | 1/1998 | Bosio |
| 5,758,690 | A | 6/1998 | Humpert et al. |
| 5,906,319 | A | 5/1999 | Crowl |
| 5,926,868 | A | 7/1999 | Bjerke |
| 5,934,325 | A | 8/1999 | Brattoli et al. |
| 6,006,784 | A | 12/1999 | Tsutsui et al. |
| 6,045,062 | A | 4/2000 | Bosio |
| 6,085,790 | A | 7/2000 | Humpert et al. |
| 6,106,027 | A | 8/2000 | Mulvey et al. |
| 6,220,297 | B1 | 4/2001 | Marty et al. |
| 6,234,192 | B1 | 5/2001 | Esche et al. |
| 6,296,011 | B1 | 10/2001 | Esche et al. |
| 6,334,226 | B1 | 1/2002 | Tokunaga et al. |
| 6,370,713 | B2 | 4/2002 | Bosio |
| 6,381,770 | B1 | 5/2002 | Raisch |
| 6,381,774 | B1 | 5/2002 | Wales |
| 6,691,933 | B1 | 2/2004 | Bosio |
| 6,938,837 | B2 * | 9/2005 | Nelson et al. ..... 239/441 |
| 2001/0020302 | A1 | 9/2001 | Bosio |
| 2003/0188381 | A1 | 10/2003 | Bosio |
| 2003/0189107 | A1 | 10/2003 | Bosio |
| 2003/0189108 | A1 | 10/2003 | Bosio |

OTHER PUBLICATIONS

PICTURE 2 of Amfag Idea Product, Mar. 2001.

Amfag News, Idea Picture, http://www.amfag.com/eng/news/media.htm, Mar. 22, 2004.

Amfag Idea Otvr Picture, http://www.amfag.com/eng/news/nuovi.htm, Mar. 22, 2004.

* cited by examiner

FAUCET SPRAY HEAD ASSEMBLY

REFERENCE TO RELATED APPLICATIONS

The present application is a continuation of U.S. patent application Ser. No. 10/350,237 filed Jan. 23, 2003 now U.S. Pat. No. 6,938,837, which is hereby incorporated by reference in its entirety.

BACKGROUND OF THE INVENTION

The present invention generally relates to a faucet spray head assembly, and more specifically, but not exclusively, concerns a dual action faucet spray head that is easy to assemble as well as can be easily docked and undocked from a faucet.

With today's modern kitchen and bathroom designs, faucets have been redesigned to incorporate faucet spray heads or wands that act as both a spray head as well as a regular faucet. The convenience provided by these dual mode faucet spray heads allow the user to easily switch between a regular faucet mode in which a single, aerated stream of water is supplied and a sprayer mode in which a spray of water is supplied. The dual mode spray head can be used for cleaning dishes or vegetables, for example. Aesthetically, these dual mode spray heads reduce clutter around the sink, thereby providing a cleaner, modern environment in the kitchen. Usually, a flow switching mechanism for switching the operational mode of the spray head is located on the spray head. The switching mechanism typically incorporates a rubber boot so as to isolate the switching mechanism from the outside environment. However, with such a boot design, the user is unable to readily discern whether the spray head is in the faucet or spray mode, such that the user can accidentally spray themselves or their work area upon turning on the faucet. As should be appreciated, this rubber boot design also makes assembly of the spray head more difficult. In addition, the rubber boot can crack after repeated use, thereby diminishing the overall appearance of the spray head over time.

Typically, with such dual mode faucet heads, the spray head or wand is attached to a flexible water supply hose that is threaded from underneath the sink and through the faucet body or hub. The hose allows the user to extend the spray head from the faucet. A counterweight, which is attached to the hose underneath the sink, is used to retract the spray head. Once retracted, only the weight of the counterweight ensures that the spray head remains attached to the faucet body. It should be appreciated that with this type of design, the spray head can be easily dislodge such that water can be accidentally sprayed outside the sink. For example, the force applied by the user when actuating the flow switching mechanism can accidentally dislodge the spray head from the faucet so that the water is sprayed in the wrong direction. Moreover, the pressure of the water spraying from the spray head can cause the spray head to become accidentally dislodged.

Thus, there remains a need for improvement in this field.

SUMMARY OF THE INVENTION

One aspect of the present invention concerns a faucet spray head that includes a diverter valve. The diverter valve has a diverter stem constructed and arranged to control water flow patterns from the faucet spray head. The stem includes a neck and a head that is larger than the neck. A shell encloses the diverter valve, and the shell has an opening through which the stem extends. A pivot member is coupled to the shell. A rocker arm is pivotally coupled to the pivot member, and the rocker arm has a retention opening. The retention opening is constructed and arranged to slidably receive and retain the head of the stem during assembly of the rocker arm to the pivot member.

Another aspect concerns a spray head assembly that includes a spout that defines a spout opening and a lock tab opening. A supply hose is slidably received in the spout opening. A spray head is coupled to the hose, and the spray head has at least one lock pin. A lock insert is received in the spout, and the lock insert has a lock tab received in lock tab opening to secure the lock insert to the spout. The lock insert defines at least one lock pin opening constructed and arranged to detachably retain the lock pin of the spray head.

A further aspect concerns a method of assembling a spray head. The method includes attaching a pivot member to a spray head shell. The spray head shell has a diverter stem of a diverter valve extending therefrom. The stem includes a neck and a head that is larger than the neck. A head opening that is defined in a rocker arm is positioned over the head of the diverter stem. The rocker arm has a retention opening positioned proximal to the head opening. The retention opening has a pair of retention flanges that define a gap that is larger than the neck and smaller than the head of the diverter stem. The rocker arm is secured to the diverter stem by sliding the neck of the diverter stem between the retention flanges. The rocker arm is mounted on the pivot member by pivotally securing the rocker arm to the pivot member.

Further forms, objects, features, aspects, benefits, advantages, and embodiments of the present invention will become apparent from a detailed description and drawings provided herewith.

DESCRIPTION OF SELECTED EMBODIMENTS

Figure 2:
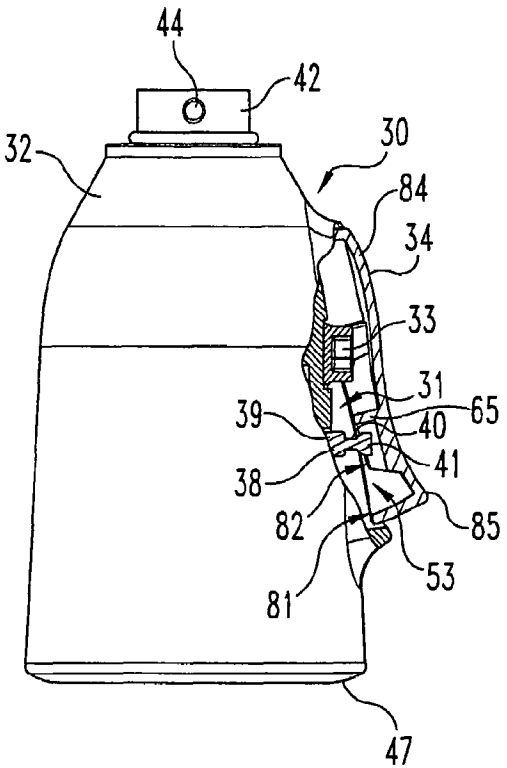
FIG. 2 is a side, partial cross sectional view of the FIG. 1 spray head.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
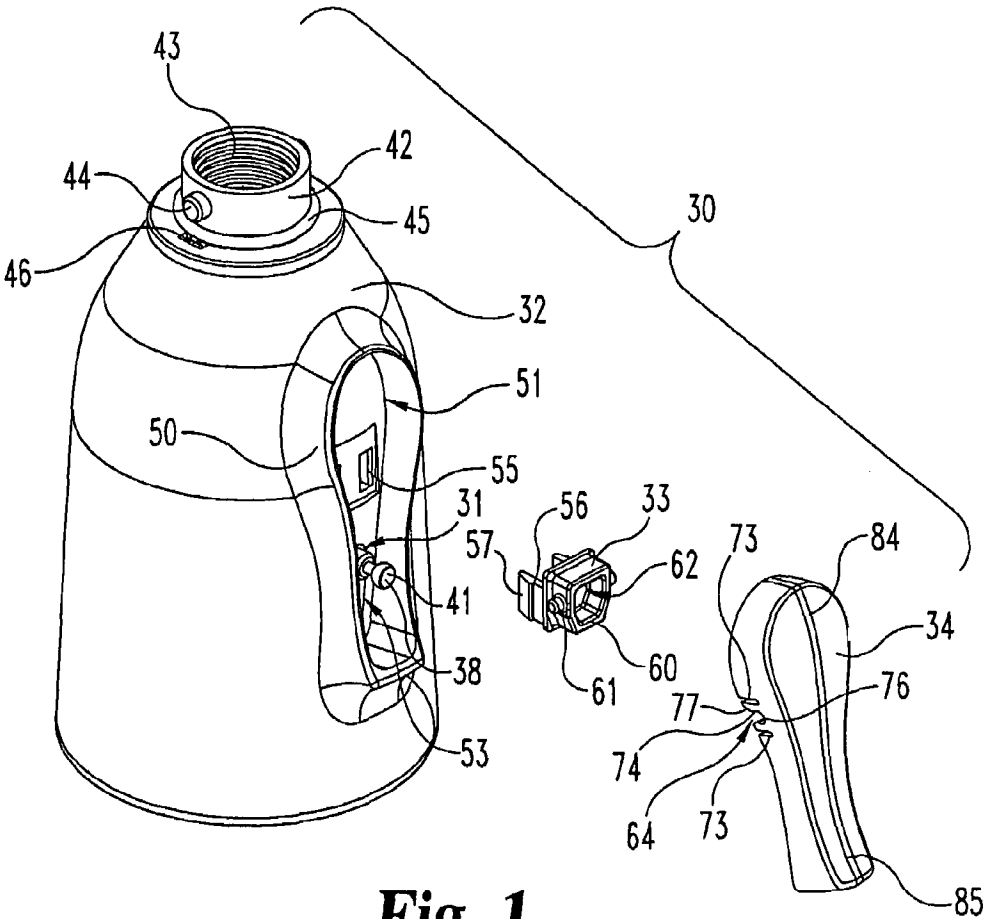
FIG. 1 is an exploded view of a faucet spray head with a rocker switch assembly according to one embodiment of the present invention.

A spray head assembly 30 according to one embodiment of the present invention is illustrated in FIGS. 1–4. Although the spray head assembly 30 according to the present invention will be described with reference to a water faucet, it is contemplated that selected features of the present invention can be adapted for use in other fields. As shown in FIGS. 1 and 2, the spray head assembly 30 includes a diverter valve assembly 31 which is used to change the fluid flow in the spray head 30 between a faucet mode and a spray mode. An outer shell 32 encloses the diverter valve 31. In the illustrated embodiment, the outer shell 32 is bell shaped, but it is contemplated that the outer shell 32 can be shaped differently. The spray head assembly 30 further includes a pivot member 33 that is attached to the outer shell 32, and a rocker arm or switch 34 is pivotally mounted on the pivot member 33. In one embodiment, the outer shell 32, the pivot member 33 and the rocker arm 34 are made of plastic. However, it is contemplated that these components can be made from other types of materials.

Figure 3:
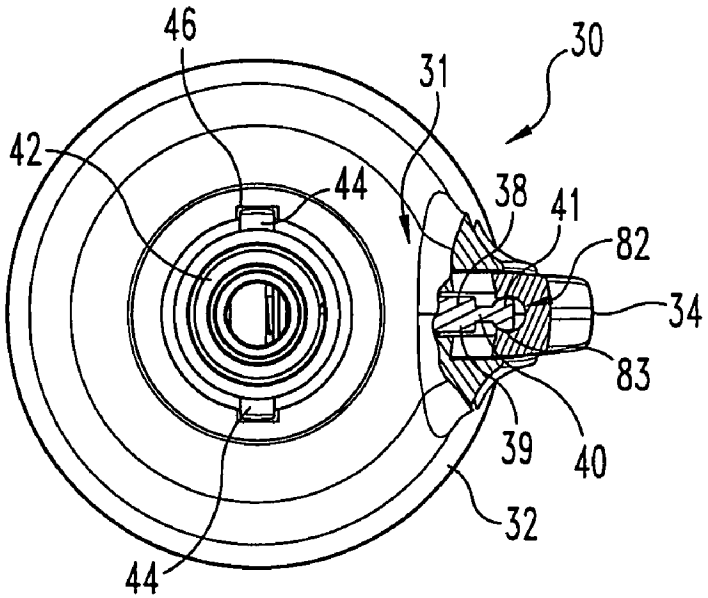
FIG. 3 is a top, partial cross sectional view of the FIG. 1 spray head.

As previously mentioned, the diverter valve assembly 31 is used to change the operational mode of the spray head assembly 30 from a normal faucet mode to a spray mode, and back. In one embodiment, the diverter valve assembly 31 is an AMFAG brand diverter valve of the type that is disclosed in U.S. Pat. No. 6,370,713, which is hereby incorporated by reference in its entirety. As should be appreciated, the spray head assembly 30 can incorporate other types of flow diverter valves. As depicted in FIGS. 2 and 3, the diverter valve 31 includes a diverter stem 38 that is used to actuate the diverter valve 31. In one embodiment, when the diverter stem 38 is extended or pulled away from the shell 32, the spray head assembly 30 supplies the water as a single, aerated stream, and when the diverter stem 38 is pushed in an inward direction relative to the shell 32, the spray head 30 delivers the water as a spay. Nevertheless, it is should be appreciated that the diverter valve 31 can operate in an opposite fashion in other embodiments.

Referring to FIG. 3, the diverter stem 38 includes a body portion 39 where the stem 38 is attached to the rest of the valve 31, a neck portion 40 that extends from the body portion 39, and a head portion 41 that extends from the neck portion 40. The neck portion 40 in the illustrated embodiment is thinner than both the body portion 39 and the head portion 41. Proximal to the neck portion 40, the head 41 of the stem 38 in one form of the present invention is rounded. In the illustrated embodiment, the diverter stem 38 has an overall cylindrical shape, but it should be appreciated that the diverter stem 38 can be shaped differently. As shown in FIG. 1, valve body 42 of the diverter valve 31 has, at one end, an internally threaded opening 43 to which a water supply hose is threadedly attached. Around the threaded opening 43, the valve body 42 has one or more lock pins 44 that are used to secure the spray head 30 to the rest of the faucet. In the illustrated embodiment, the spray head 30 has a pair of oppositely disposed lock pins 44 that are used to secure the spray head 30. Around the threaded opening 43 of the valve body 42, the spray head 30 further includes a gasket 45. In the illustrated embodiment, gasket 45 is in the form of an o-ring, but in other embodiments, the gasket 45 can be shaped differently. As depicted in FIGS. 1 and 3, the outer shell 32 defines a pair of lock pin slots 46 through which the lock pins 44 slide through the outer shell 32 during assembly. The diverter valve 31, as illustrated in FIG. 2, is enclosed inside the outer shell 32 through a spray member or ring 47 that is threadedly secured to the shell 32.

As depicted in FIG. 1, the outer shell 32 has a rocker arm flange 50 that defines a rocker arm cavity 51 in which the rocker arm 34 is received. As shown, the rocker arm cavity 51 has a contour, which generally corresponds to the peripheral shape of the rocker arm 34. The rocker arm flange 50 aids in giving the spray head 30 an overall finished appearance. Moreover, flange 50 prevents someone from tampering with or removing the rocker arm 34, once the rocker arm 34 is attached to the shell 32. Inside the rocker arm cavity 51, the shell 32 defines a diverter stem opening 53 through which diverter stem 38 extends. In the illustrated embodiment, the diverter stem opening 53 is in the form of an elongated slot. However, it should be appreciated that the diverter stem opening 53 can be shaped differently.

So as to reduce the cost of molding the outer shell 32, the pivot member 33 in the illustrated embodiment is a separate component that is attached to the outer shell 32 during assembly of the spray head 30. If the pivot member 33 was molded inside the rocker arm cavity 51 of the outer shell 32, an undercut problem would arise in the mold design. To form the shell 32 and the pivot member 33 as a unitary piece, one type of mold design would require an articulation piece, such as an externally sliding core piece, in order to form the pivot member 33. This mold design, nevertheless, would increase cost of the mold as well as the overall manufacturing costs associated with the spray head 30. Molding the outer shell 32 and the pivot member 33 separately, however, simplifies the mold design. To permit attachment of the pivot member 33, the outer shell 32 inside the rocker arm cavity 51 further defines one or more lock tab openings 55. The pivot member 33 includes one or more lock tabs 56 with lock flanges 57 that secure the lock tabs 56 inside the lock openings 55. In the embodiment illustrated in FIG. 1, the pivot member 33 has a pair of lock tabs 56. Body 60 of the pivot member 33 has a pair of opposing pivot pins 61 extending therefrom. Although a pair of pivot pins 61 are shown in the illustrated embodiment, it is contemplated that the pivot member 33 can include one or more pivot pins 61. To reduce the amount of material involved in forming the pivot member 33, the body 60 of the pivot member 33 defines a relief cavity 62.

Figure 4:
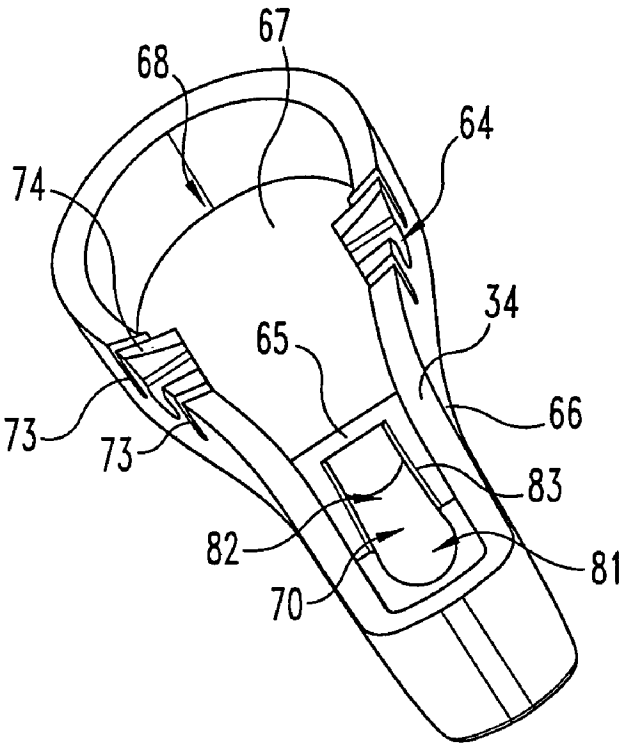
FIG. 4 is a perspective view of the rocker arm used in the rocker arm assembly of FIG. 1.

With reference to FIG. 1, the rocker arm 34 defines oppositely disposed pivot pin openings 64 in which the pivot pins 61 of the pivot member 33 are received. In another embodiment, the pivot member 33 incorporates the pivot openings 64, and the rocker arm 34 has the pivot pins 61. As illustrated in FIG. 4, the rocker arm 34 has a divider wall 65, a peripheral wall 66 and an exterior wall 67 that together define a pivot member cavity 68 in which the pivot member 33 is received. Walls 65, 66 and 67 further define a diverter stem cavity 70 in which the head 41 of the diverter stem 38 is secured. As shown in FIGS. 1 and 4, the pivot pin openings 64 are positioned to open into the pivot member cavity 68 so that the pivot pins 61 are able to engage the pivot pin openings 64. Around each pivot opening 64, a pair of expansion notches 73 are defined in the peripheral wall 66 so as to form expansion arms 74. The expansion notches 73 allow the expansion arms 74 to deflect away from one another when the pivot pins 61 are inserted into the pivot openings 64. As shown in the FIG. 1 embodiment, each pivot opening 64 includes a semi-circular portion 76 that is configured to receive the cylindrically shaped pivot pins 61, and the opening of the semi-circular portion 76 is sized to retain the pivot pin 61 inside the pivot opening 64. Proximal the opening of the semi-circular portion 76 the expansion arms 74 include beveled portions 77 that aid in guiding the pivot pins 61 into the semi-circular opening portions 76.

As noted above, the diverter stem cavity 70 is configured to retain the diverter stem 38 so as to secure the rocker arm 34 to the outer shell 32. In the embodiment illustrated in FIGS. 2–4, the diverter stem cavity 70 is in the form of a slot. Opposite the divider wall 65, the stem cavity 70 includes an insertion portion 81 that is sized to receive the head 41 of the diverter stem 38. Proximal the divider wall 65, the stem cavity 70 includes a retention portion 82 that is configured to retain the head 41 of the diverter stem 38 inside the stem cavity 70. As depicted in FIG. 3, the retention portion 82 has retention ridges 83 that form an opening that is smaller than the head 41 of the diverter stem 38, but the opening between the retention ridges 83 is large enough to receive the neck 40 of the stem 38. To reduce the profile of the rocker arm 34 on the shell 32, the rocker arm 34 in FIGS. 1 and 2 has a first end 84 with a concave shape so as to generally coincide with the shape of the shell 32. Opposite the first end 84, the rocker arm 34 has a second end 85 that flares away from the outer shell 32, which in turn facilitates actuation of the rocker arm 34.

As should be appreciated, the spray head assembly 30 according to the present invention simplifies the assembly process for the spray head 30. During assembly, as shown in FIG. 1, the pivot member 33 is attached to the outer shell 32 by snapping the lock tabs 56 of the pivot member 33 into the lock tab openings 55 of the shell 32. The rocker arm 34 is then positioned so that the insertion portion 81 of the stem cavity 70 is positioned over the head 41 of the stem 38. The head 41 is then slid into the retention portion 82 of the stem cavity 70, thereby securing the rocker arm 34 to the stem 38, as is illustrated in FIGS. 2 and 3. The pivot openings 64 in the rocker arm 34 are positioned over the pivot pins 61 on the pivot member 33, and the pivot pins 61 are snapped into the pivot openings 64 so that the rocker arm 34 is secured to the rest of the spray head 30. With such a construction, the spray head 30 has a clean overall appearance. Moreover, the rocker switch 34 in the spray head 30 according to the present invention can be easily attached to the outer shell 32, but cannot be easily removed. As noted above, the rocker arm flange 50 prevents the user from prying the rocker arm 34 from the pivot member 33.

To operate the spray head 30, the first end 84 of the rocker arm 34 can be depressed so as to extend the diverter stem 38. As mentioned above, depending on the configuration of the diverter valve 31, extending the diverter stem 38 can cause the spray head 30 to supply spray or a single stream of water. By pressing on the second end 85 of the rocker arm 34, the stem 38 of the diverter valve 31 is pushed inwards such that the operational mode of the spray head 30 is changed. For example, in one embodiment, when the first end 84 of the rocker arm 34 is depressed, the spray head 30 supplies a spray of water, and when the second end 85 is depressed, a single stream of aerated water is supplied.

Figure 5:
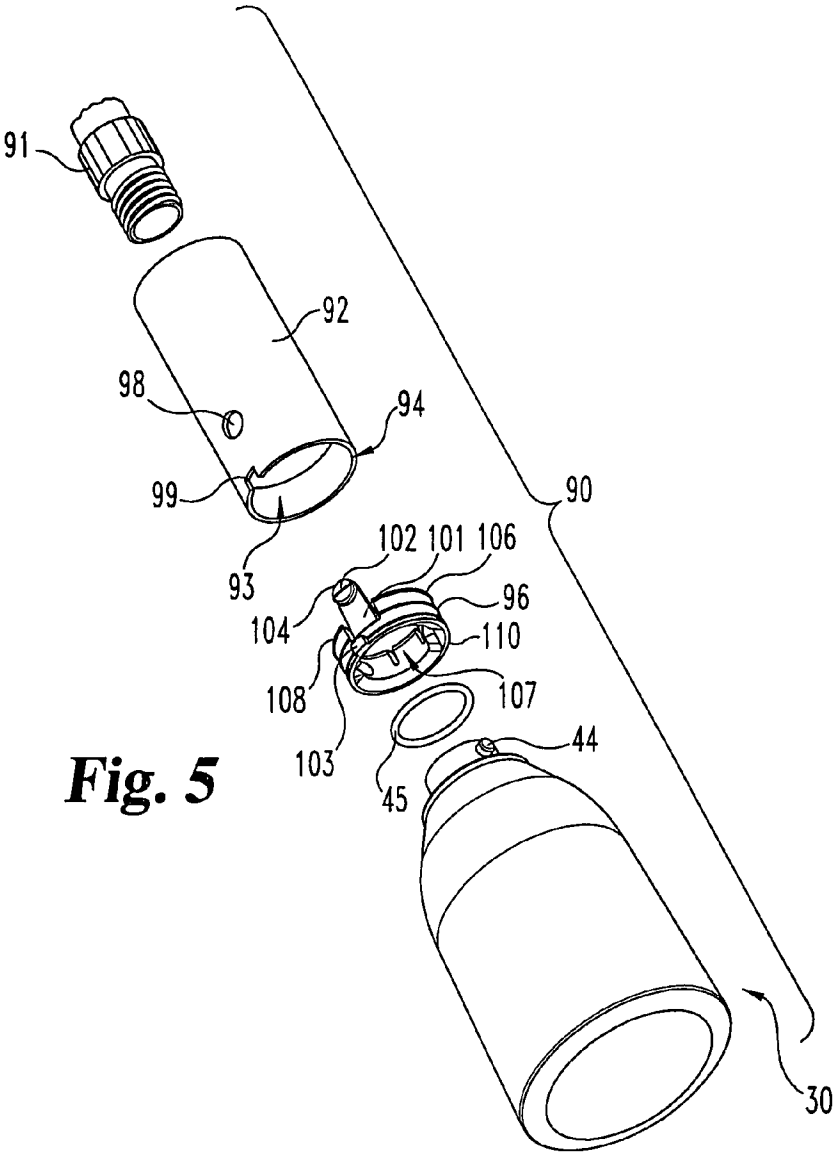
FIG. 5 is an exploded view of a spray head docking assembly according to a further embodiment of the present invention.

As previously discussed, one problem associated with pull-out type spray heads is that the spray head may not always be firmly secured when docked with the rest of the faucet. If the spray head is accidentally dislodged, the spray head may spray water where it is not desired, such as on the countertop or on the floor. A spray head docking system 90 according to one embodiment of the present invention solves this docking problem by providing a secure connection when the spray head is docked, while at the same time permitting easy detachment of the spray head. As illustrated in FIG. 5, the spray head docking system 90 includes a fluid supply hose 91, which supplies water to the spray head 30. The supply hose 91 is threadedly secured to the threaded opening 43 in the spray head 30, and the hose 91 is slidably received inside a spout member 92. In the illustrated embodiment, the spout 92 has a generally cylindrical shape and is generally straight. However, it should be appreciated that the spout 92 can be shaped differently. For example, the spout 92 may be bent into u-shape for accommodating different faucet styles. As shown in FIG. 5, the spout 92 defines a hose cavity 93 through which the supply hose 91 passes, and the spout 92 has a docking end portion 94. A lock insert 96 is attached inside the docking end portion 94 of the spout 92 for detachably securing the spray head 30 to the spout 92. In one form, the lock insert 96 is made of plastic, but it should be appreciated that the lock insert 96 can be formed from other materials. The hose 91 slides within the lock insert 96 when the hose 91 is extended and retracted. With the hose 91 sliding within the lock insert 96, the lock insert 96 acts as a guide, which reduces the amount of wear on the hose 91.

Figure 6:
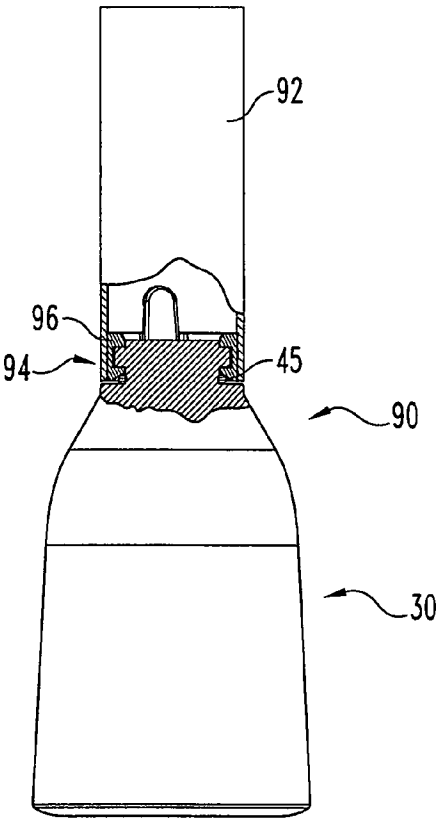
FIG. 6 is a partial cross sectional view of the FIG. 5 assembly.

FIG. 6 illustrates a partial cross-sectional view of the docking system 90 when the spray head 30 is docked with the spout 92. For the sake of clarity, the hose 91 is not illustrated in FIG. 6, but it should be understood that the hose 91 is normally attached to the spray head 30 when the spray head 30 is in the docked position. The spray head 30 in the spray head docking system 90 of FIGS. 5 and 6 is attached and detached from the spout 92 in a manner similar to that of a bayonet. As shown, the spout 92 defines a lock tab opening 98 that is used for securing the lock insert 96 to the spout 92. The spout 92 further defines an orientation notch 99 at the docking end portion 94 of the spout 92. The orientation notch 99 is used to orient the lock insert 96 in the spout 92, and further prevents the lock insert 96 from rotating inside the spout 92 during docking and undocking of the spray head 30. In the illustrated embodiment, the lock insert 96 has a generally cylindrical shape in order to coincide with the shape of the hose cavity 93 in the spout 92. Nevertheless, it is contemplated that the insert 96 can have a different overall shape, depending on the shape of the spout 92.

With continued reference to FIG. 5, the lock insert 96 has a lock arm 101 with a lock tab 102 that is constructed and arranged to be received inside the lock tab opening 98. The lock insert 96 further has an alignment tab 103 extending radially therefrom that is configured to be received into the orientation notch 99. In the illustrated embodiment, the lock tab 102 has a generally circular or cylindrical shape in order to coincide with the shape of the lock tab opening 98. The lock tab 102 further has a beveled surface 104 so as to make insertion of the lock tab 102 easier. Alignment tab 103 in the illustrated embodiment has a generally rectangular shape in order to fit inside the orientation notch 99. As shown, the outer periphery of the lock insert 96 further has seal rings 106 that engage the docking end portion 94 of the spout 92. With the lock insert 96 constructed in such a manner, the lock insert 96 can be easily replaced when it becomes worn or damaged. Alternately, the lock insert 96 can be easily replaced with another type of lock insert that is configured to dock the spray head 30 in a different manner. For example, lock insert 96 could be replaced with the one illustrated in FIGS. 10–14, which will be described below.

Figure 8:
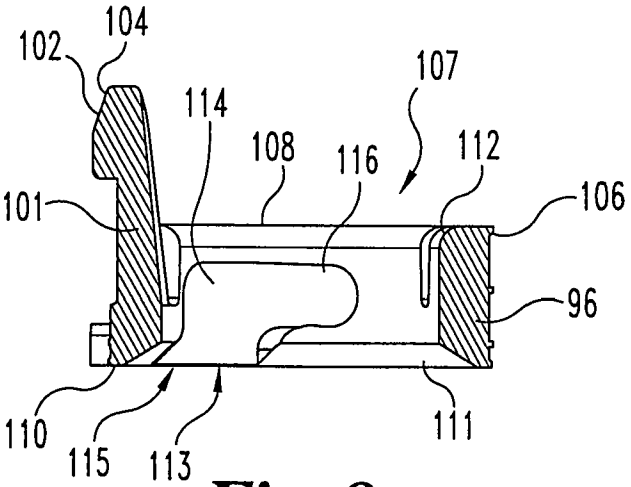
FIG. 8 is a cross sectional view of the FIG. 7 lock insert as taken along line 8—8 in FIG. 7.
Figure 7:
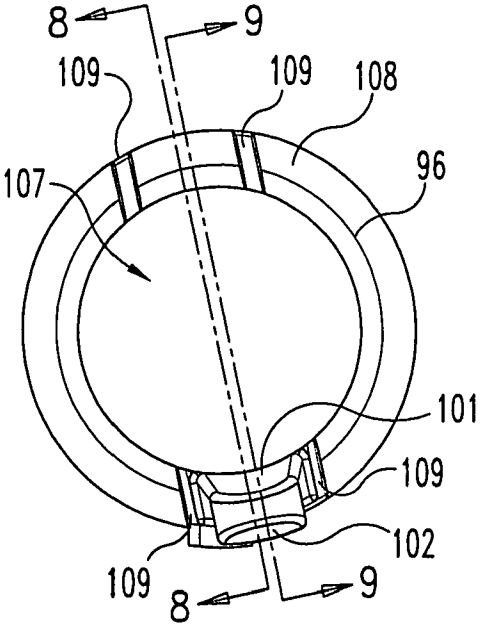
FIG. 7 is a top view of a lock insert used in the FIG. 5 assembly.
Figure 12:
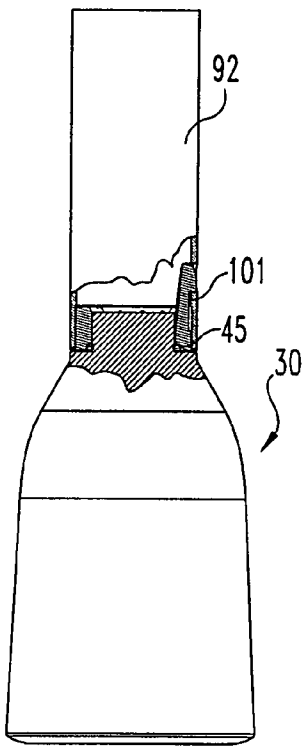
FIG. 12 is a side, partial cross sectional view of the FIG. 10 assembly.
Figure 11:
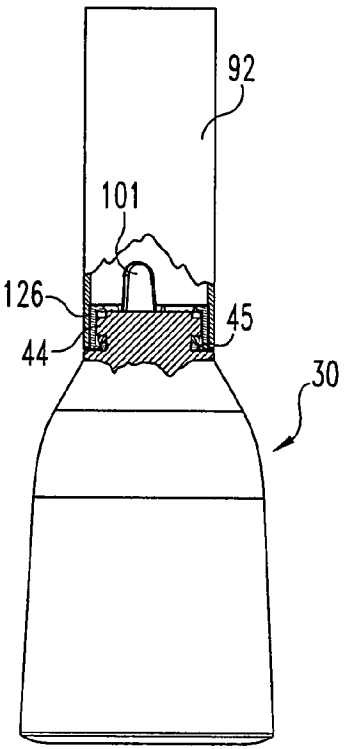
FIG. 11 is a front, partial cross sectional view of the FIG. 10 assembly.
Figure 10:
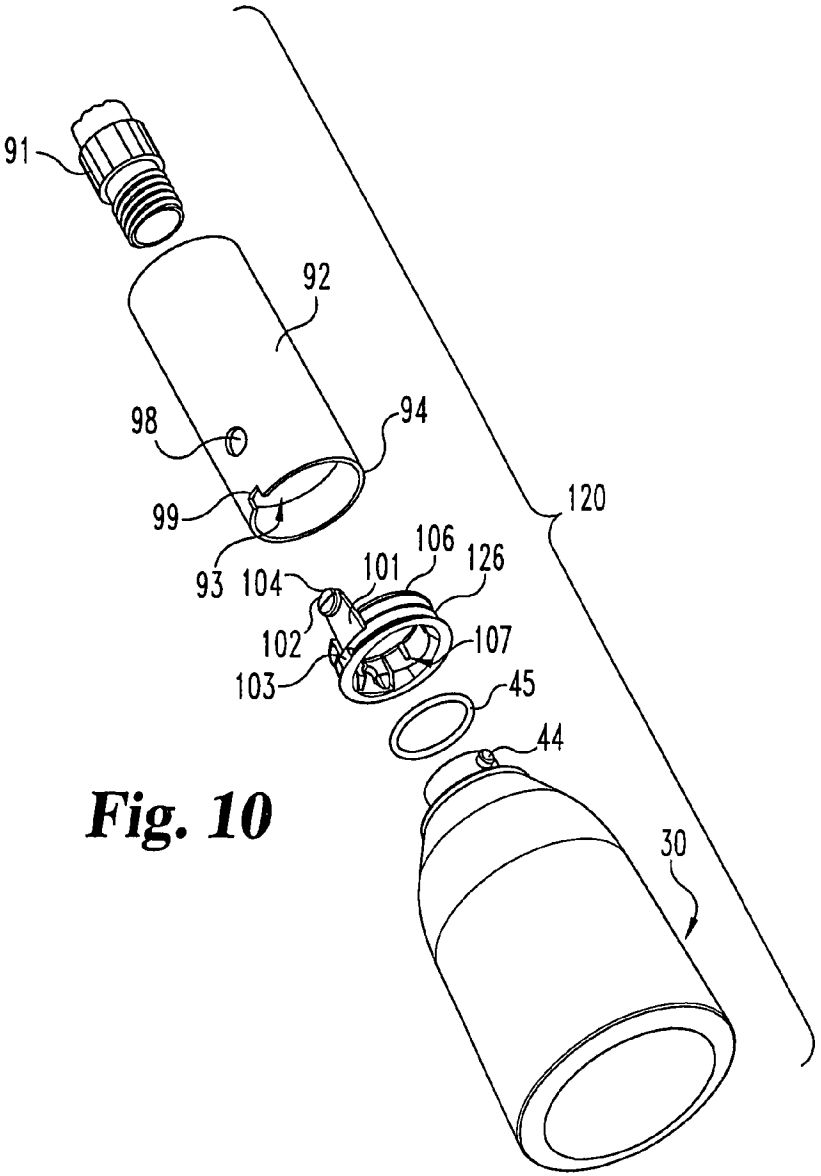
FIG. 10 is an exploded view of a spray head docking assembly according to another embodiment of the present invention.

As shown in FIG. 7, the lock insert 96 defines a spray head receptacle or opening 107 in which the spray head 30 is attached. The spray head receptacle 107 acts as a guide for the hose 91 such that the hose 91 smoothly extends from the spout 92. The lock insert 96 has a spout facing end 108 that is inserted inside the hose cavity 93, and the spout facing end 108 has a pair of relief notches 109 that extend in a parallel relationship with respect to one another and on opposite sides of the lock arm 101. These relief notches 109 aid in inserting the lock insert 96 into the spout 92. Opposite end 108, the lock insert 96 has a spray head-facing end 110, which is illustrated in FIG. 8. The spray head-facing end 110 of the lock insert 96 has a beveled edge 111 formed around the spray head receptacle 107. Similarly, the spout-facing end 108 has a beveled edge 112 formed around the spray head receptacle 107. Beveled edge 112 aids in aligning the spray head 30 during docking as well as in retaining the o-ring 45, once the spray head 30 is docked.

Figure 9:
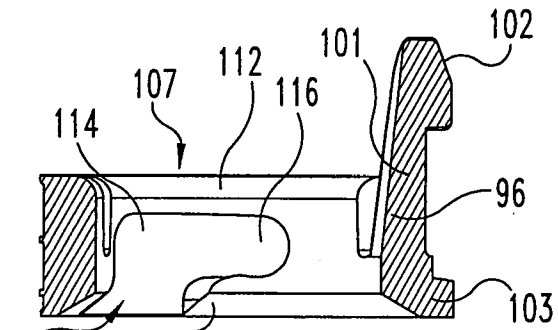
FIG. 9 is a cross sectional view of the FIG. 7 lock insert as taken along line 9—9 in FIG. 7.

As previously mentioned, the lock insert 96 in the embodiment illustrated in FIGS. 7–9 incorporates a bayonet-style socket 113. Referring to FIGS. 8 and 9, the bayonet socket 113 includes a pair of opposing bayonet notches 114. The bayonet notches 114 are in the form of L-shaped slots with each having an opening portion 115 in which one of the pins 44 of the spray head 30 is inserted and a lateral cavity 116 in which the pin 44 is secured. To attach the spray head 30 to the spout 92, the pins 44 are inserted into corresponding opening portions 115 of the bayonet slots 114. The spray head 30 is then twisted in a counterclockwise fashion, thereby securing the pins 44 into the lateral cavity 116 in the lock insert 96. Once the pins 44 are in the lateral cavities 116, the spray head 30 is firmly secured to the spout 92. The o-ring 45 helps to ensure that the spray head 30 is firmly secured within the bayonet socket 113. To detach the spray head 30 from the spout 92, the spray head 30 is rotated in a clockwise fashion such that the pins 44 disengage from the bayonet notches 114. In another embodiment, the bayonet notches 114 are oriented in an opposite fashion such that the spray head 30 is docked and undocked by rotating the spray head 30 in clockwise and counter directions, respectively.

Figure 14:
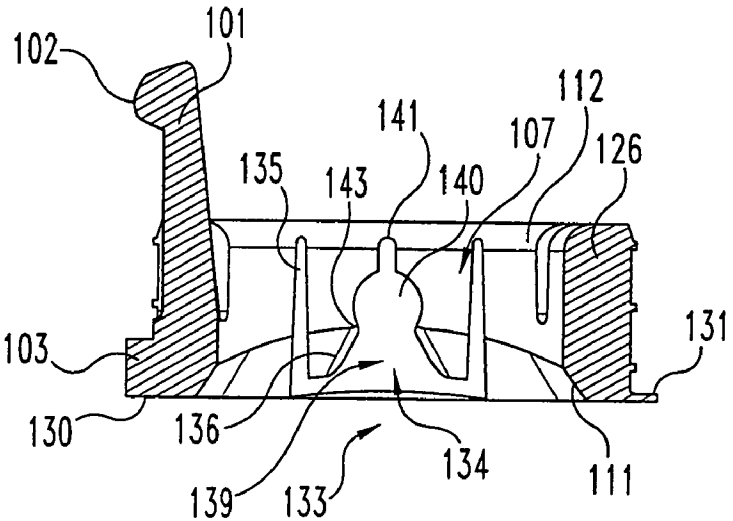
FIG. 14 is a cross sectional view of the FIG. 13 lock insert as taken along line 14—14 in FIG. 13.
Figure 13:
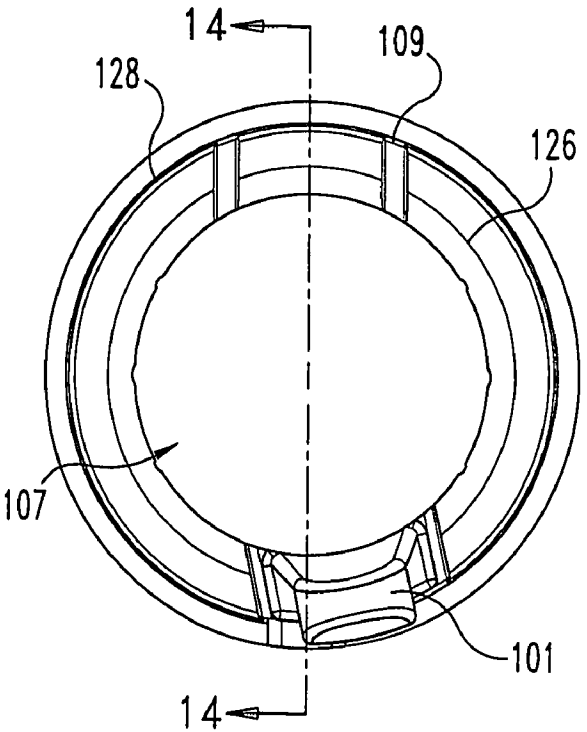
FIG. 13 is a top view of a lock insert used in the FIG. 10 assembly.

A spray head docking system 120 according to another embodiment of the present invention is illustrated in FIGS. 10–14. The spray head docking system 120 includes a number of components that are similar to the ones described above, including the hose 91, the spout 92, the O-ring 45, and the spray head 30. In the spray head docking system 120, lock insert 126 differs from the lock insert 96 as described above. However, as will be appreciated from the discussion below, the lock insert 126 illustrated in FIGS. 10–14 in many respects shares a number of features that are common with the lock insert 96 in illustrated in FIG. 5. For instance, lock insert 126 includes the lock arm 101, the lock tab 102, the alignment tab 103, and the seal rings 106. The spray head 30 in system 120, however, is attached and detached from the lock insert 126 in a different manner. Instead of twisting the spray head 30 as is required for docking and undocking the spray head 30 in the bayonet-type socket 113 in the FIG. 5 embodiment, the lock insert 126 illustrated in FIG. 10 uses a straight in-and-out method for docking and undocking the spray head 30. As illustrated in FIGS. 13 and 14, the lock insert 126 is generally ring-shaped and defines spray head opening 107. Similar to the previous embodiment, lock insert 126 has relief notches 109 defined in spout facing end 128 of the lock insert 126 and beveled edge 112 around opening 107. Likewise, spray head facing end 130 of the lock insert 126 has beveled edge 111 around opening 107 for directing the spray head 30 into the opening 107. The spray head-facing end 130 further includes a retention edge 131 that radially extends from end 130. The retention edge 131 rests against the spout 92 so as to prevent the lock insert 126 from being pushed into the hose cavity 93, when the spray head 30 is attached. The alignment tab 103, in conjunction with the orientation notch 99 in the spout 92, prevents rotational movement of the lock insert 126 in the spout 92.

The lock insert 126 forms a spray head socket 133 that is adapted to detachably couple the spray head 30 to the spout 92. As illustrated in FIG. 14, spray head socket 133 includes one or more pin receptacle notches 134 that are configured to receive and retain the pins 44 on the spray head 30. In the illustrated embodiment, the spray head socket 133 includes a pair of notches 134 that are disposed on opposite sides of the spray head opening 107. Each pin receptacle notch 134 is surrounded by a pair of deflection notches 135, which together define a pair of socket arms or protrusions 136. In the receptacle notch 134, the socket arms 136 define an entrance portion 139 that has a beveled shape, a pin retention portion 140, and an expansion slot 141. The beveled shape of the entrance portion 139 helps in the insertion of the pins 44 into the socket 133. In the illustrated embodiment, the pin retention portion 140 has semi-circular shape so as to coincide with the shape of the pins 44. Between the entrance portion 139 and the pin retention portion 140, notch 134 is narrowed by retention flanges 143 that extend towards one another on arms 136. The expansion slot 141 and the deflection notches 135 together allows the socket arms 136 to resiliently deflect from one another during insertion of the pins 44 between the retention flanges 143. Once the pins 44 are received inside the pin retention portion 140, the arms 136 deflect back to their original position so that the retention flanges 136 retain the pins 44 within the socket 133. Consequently, the spray head 30 is docked with the spout 92. To remove the spray head 30 from the spout 92, the user simply pulls the spray head such that the pins 44 become disengaged from the socket 133.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus, comprising:

a faucet spray head including a diverter valve having a diverter stem constructed and arranged to control water flow patterns from said faucet spray head, said stem including a neck and a head that is larger than said neck, a shell enclosing the diverter valve, said shell having an opening through which said stem extends, a pivot member coupled to said shell, and a rocker arm pivotally coupled to said pivot member, said rocker arm having a retention opening, said retention opening being constructed and arranged to slidably receive and retain said head of said stem during assembly of said rocker arm to said pivot member.

2. The apparatus of claim 1, wherein said pivot member and said shell are separate components.

3. The apparatus of claim 1, further comprising:
one or more lock pins extending from said spray head;
a spout; and
a lock insert received in said spout, wherein said lock insert includes a lock pin socket constructed and arranged to receive and hold said lock pins of said spray head.

4. The apparatus of claim 3, wherein:
said spout defines a lock tab opening and an orientation notch; and
said lock insert includes a lock tab coupled in said lock tab opening and an alignment tab received in said orientation notch.

5. The apparatus of claim 3, wherein said lock pin socket includes one or more lock pin openings having a bayonet shape.

6. The apparatus of claim 3, wherein said lock pin socket includes one or more lock pin openings configured for straight in and out docking of said faucet spray head.

7. An apparatus, comprising:
a spout defining a spout opening and a lock tab opening;
a supply hose slidably received in said spout opening;
a spray head coupled to said hose, said spray head having at least one lock pin; and
a lock insert received in said spout, said lock insert having a lock tab received in said lock tab opening to secure said lock insert to said spout, said lock insert defining at least one lock pin opening constructed and arranged to detachably retain said lock pin of said spray head.

8. The apparatus of claim 7, wherein said lock pin opening has a bayonet shape.

9. The apparatus of claim 7, wherein said lock insert defines a retention flange to prevent said lock insert from being pushed further inside said spout during docking of said spray head.

10. The apparatus of claim 7, further comprising an o-ring disposed between said spout and said spray head to ensure that said spray head is firmly secured to said spout.

11. The apparatus of claim 7, wherein said lock pin opening includes an opening portion for receiving said lock pin and an a lateral cavity laterally offset from said opening portion for securing said lock pin.

12. The apparatus of claim 11, wherein:
said spout defines an orientation notch; and
said lock insert includes an alignment tab received in said orientation notch to minimize rotation of said lock insert.

13. The apparatus of claim 7, wherein said lock insert is made of plastic.

14. The apparatus of claim 7, wherein said spray head includes:
a diverter valve having a diverter stem constructed and arranged to control water flow patterns from said spray head, said stem including a neck and a head that is larger than said neck;
a shell enclosing the diverter valve, said shell having an opening through which said stem extends;
a pivot member coupled to said shell; and
a rocker arm pivotally coupled to said pivot member, said rocker arm having a retention opening, said retention opening being constructed and arranged to slidably receive and retain said head of said stem during assembly of said rocker arm to said pivot member.

15. A method of assembling a spray head, comprising:
attaching a pivot member to a spray head shell, the spray head shell having a diverter stem of a diverter valve extending therefrom, the stem including a neck and a head that is larger than the neck;
positioning a head opening defined in a rocker arm over the head of the diverter stem, the rocker arm having a retention opening proximal the head opening, the retention opening having a pair of retention flanges that define a gap that is larger than the neck and smaller than the head of the diverter stem;
securing the rocker arm to the diverter stem by sliding the neck of the diverter stem between the retention flanges; and
mounting the rocker arm on the pivot member by pivotally securing the rocker arm to the pivot member.

16. The method of claim 15, wherein:
the pivot member includes a pair of lock tabs;
the spray head shell defines a pair of lock tab openings; and
said attaching the pivot member includes locking the lock tabs of the pivot member into the lock tab openings.

17. The method of claim 16, wherein:
the pivot member has one or more pivot pins;
the rocker arm defines one or more pivot pin openings; and
said mounting the rocker arm includes securing the pivot pins in the pivot pin openings.

18. An apparatus, comprising:
a spout;
a lock insert coupled to said spout;
a spray head having at least one lock member; and
wherein said lock insert defines at least one lock member opening, said lock member opening includes an opening portion to receive said lock member and a lateral cavity laterally offset from said opening portion to secure said lock member upon rotation of said spray head.

19. The apparatus of claim 18, wherein said lock member opening is L-shaped.

20. The apparatus of claim 18, wherein:
said lock insert has a lock tab; and
said spout defines a lock tab opening to which said lock tab is secured.

21. The apparatus of claim 18, wherein:
said spout defines an orientation notch; and
said lock insert includes an alignment tab received in said orientation notch to minimize rotation of said lock insert.

22. The apparatus of claim 18, wherein said lock insert has one or more seal rings that engage said spout.

23. The apparatus of claim 18, further comprising a hose coupled to said spray head, wherein said hose is slidably disposed to extend through said lock insert.

24. The apparatus of claim 18, further comprising means for ensuring that said spray head is firmly secured to said spout.

25. The apparatus of claim 24, wherein said means for ensuring that said spray head is firmly secured to said spout includes an o-ring.

* * * * *